US009124974B2

(12) United States Patent
Flynn

(10) Patent No.: US 9,124,974 B2
(45) **Date of Patent: *Sep. 1, 2015**

(54) HAT MOUNTED MUSIC SYSTEM

(71) Applicant: Michael Flynn, Van Nuys, CA (US)

(72) Inventor: Michael Flynn, Van Nuys, CA (US)

( * ) Notice: Subject to any disclaimer, the term of this patent is extended or adjusted under 35 U.S.C. 154(b) by 240 days.

This patent is subject to a terminal disclaimer.

(21) Appl. No.: 13/919,275

(22) Filed: Jun. 17, 2013

(65) Prior Publication Data

US 2014/0369544 A1 Dec. 18, 2014

(51) Int. Cl.
*H04R 1/02* (2006.01)
*H04R 1/10* (2006.01)

(52) U.S. Cl.
CPC ..... *H04R 1/105* (2013.01); *H04R 1/028* (2013.01); *H04R 1/1008* (2013.01); *H04R 1/1025* (2013.01); *H04R 1/1033* (2013.01); *H04R 1/1041* (2013.01); *H04R 2201/023* (2013.01); *H04R 2201/107* (2013.01); *H04R 2420/07* (2013.01); *H04R 2430/01* (2013.01); *H04R 2460/07* (2013.01)

(58) Field of Classification Search
CPC ..... H04R 5/02; H04R 5/023
USPC ..... 381/333–334, 87, 361, 364, 374, 376, 381/370; 2/269.12–269.13
See application file for complete search history.

(56) References Cited

U.S. PATENT DOCUMENTS 3,430,261 A 3/1969 Benner
3,461,463 A 8/1969 Beguin
4,104,743 A 8/1978 Bottger
4,316,290 A 2/1982 Montesi
4,347,631 A 9/1982 Newcomb
4,525,878 A 7/1985 Lowe, Jr.
4,833,726 A 5/1989 Shinoda et al.
4,858,248 A 8/1989 Goldsmith et al.
4,944,361 A 7/1990 Lindgren et al.
D333,375 S 2/1993 Ouellette
5,293,647 A 3/1994 Mirmilshteyn et al.
5,404,577 A 4/1995 Zuckerman et al.
5,410,746 A 4/1995 Gelber
5,438,698 A 8/1995 Burton et al.
5,881,160 A * 3/1999 Sheppard ..... 381/376
5,881,390 A 3/1999 Young
6,032,291 A 3/2000 Asenguah et al.
6,732,381 B1 5/2004 Lal
D501,979 S 2/2005 Lundgren
7,044,615 B2 5/2006 Gesten
8,060,950 B1 * 11/2011 Thornton ..... 2/209
2004/0204207 A1 * 10/2004 Parker ..... 455/575.2

(Continued)

*Primary Examiner* — Disler Paul
(74) *Attorney, Agent, or Firm* — David A. Belasco; Belasco Jacobs & Townsley, LLP

(57) ABSTRACT

A hat mounted music system includes a semi-rigid hatband and a flexible crown and hat bill mounted to the hatband. A retaining pocket is mounted to the hatband and is sized and shaped to hold a portable music player. First and second headphone mounts are located to align with the ears of a user. The mounts have first and second hinges. First portions of the hinges are attached to the hatband and second portions of the hinges are attached to the mounts. The hinges permit movement of the mounts from a first, open position to a second, listening position. First and second headphone modules are adapted to fit the headphone mounts. Connection wires connect the player to the headphone modules. The headphone mounts are spring-loaded and are retained in the second position by a latching mechanism. A release device allows the headphone mounts to return to the first, open position.

19 Claims, 11 Drawing Sheets

(56) References Cited

U.S. PATENT DOCUMENTS

2006/0185062 A1 8/2006 Peng et al.
2008/0295224 A1* 12/2008 Mintzer ..... 2/209.13
2008/0304682 A1 12/2008 Seade
2009/0210995 A1 8/2009 Kwon et al.

* cited by examiner

HAT MOUNTED MUSIC SYSTEM

RELATED APPLICATION

The instant Application is a divisional of U.S. application Ser. No. 12/783,869 filed May 20, 2010 and currently pending.

FIELD OF INVENTION

This invention relates to the field of systems for playing music, and more specifically to a hat mounted system incorporating an iPod or MP3 player and accessories for multi-function use of the system.

BACKGROUND OF THE INVENTION

Modern personal music systems such as iPods and MP3 players are small and convenient to use for persons traveling or participating in athletic events. However, use of these devices always presents several issues that must be addressed. The first is where the play is to be positioned while the user is moving. Will it be held in the hand, placed in a pocket or attached to an armband or other special purpose holder? The second is how the wires associated with the earphones be positioned. Will they be draped over the user's clothing, run underneath it or a combination of both? A third is how the earphones will be attached to the user's ears so as not to become dislodged while the user is in motion. The standard music player earphones are small "ear buds" that are placed into the user's ear canals. For most users, this type of earphone arrangement is unsatisfactory for use during exercise or even walking as the ear buds tend to fall out. A fourth concern relates to how the music player battery will be charged sufficiently so as to be available for use upon demand. Many inventions have been developed that address some of these needs.

U.S. Patent Application No. 2009/0210995, published for Kwon et al., discloses a a headwear with a receiving part for a portable audio device, and more particularly, to a headwear with a receiving part for portable audio devices which is capable of receiving a portable audio device and an earphone to facilitate listening to music. The headwear with receiving part for portable audio device according to the present invention includes a crown part which is a body of the headwear; a visor part attached to lower front part of the crown part; and a size adjustment part attached to a lower rear part of the crown part, wherein a portable audio device receiving part for receiving a portable audio device is provided at a side surface of the crown part and an earphone holder for holding an earphone cord of the portable audio device is placed at an inside of the size adjustment part.

U.S. Patent Application No. 2006/0185062, published for Peng et al. is directed to a head-mounted MP3 player usable during sports has a head-mounted sports device, an MP3 module, a fixing device, and at least an earphone. The MP3 module is fixed by the fixing device on the head-mounted sports device such as a hat, a sun-hat, a hard helmet, a soft helmet, a head band, a hair ring, a headscarf, a swimming hat, or a diving helmet. The earphone is electrically connected to the MP3 module via a signal cable. The MP3 player can thus be fixed on a user's head. When the user exercises, the MP3 module can be worn on his head with the head-mounted sports device. Moreover, the MP3 module won't fall to cause its damage during sports.

U.S. Pat. No. 6,732,381, issued to Lal, illustrates a sports helmet for providing a user with a protective sports helmet that would include features such as an mp3 player, a radio, and a cellular telephone. The sports helmet includes a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

U.S. Pat. No. 7,044,615 , issued to Gesten disclose an audio system and hat connection assembly incorporated into or adapted for connecting to a hat and comprising a first connection plate and corresponding second connection plate that connect through or to the bill or hat material wherein the first section is adapted for storing the audio circuit and speaker components and connects to the second section in a manner that grips the hat material and provides access to the audio controls. In an alternative embodiment, the connection assembly may comprise a clip that secures the audio system to the hat without penetrating it. The assembly includes storage space for securing at least one speaker and audio system, which may be adapted for storing other items, such as money and keys.

U.S. Pat. No. 6,996,846, issued to Bloom, Jr. is directed to an improved visor-type face shield for dentist includes a visor portion and a shield portion coupled to each other by a first pivotable connecting means and second pivotable connecting means. The visor portion comprises a visor assembly, including a visor member and a forehead member, a visor first extension, a visor second extension, and a band, which is coupled with the first and visor second extensions by the band first connection means and band second connection means respectively. The shield portion includes a face shielding means comprising a rest extended from the face shield inner surface, a shield lower portion, a shield upper portion, a shield first connecting means of the first pivotable connecting means, and a shield second connecting means of the second pivotable connecting means. The face shielding means has the curved configuration forming some kind of semi-circular shape or the like, and the lower portion of the face shielding means is bent below the dentist's chin while the upper portion of the face shielding means is bent over the dentist's head.

U.S. Pat. No. 7,044,615 , issued to Gesten, discloses an audio system and hat connection assembly incorporated into or adapted for connecting to a hat and comprising a first connection plate and corresponding second connection plate that connect through or to the bill or hat material wherein the first section is adapted for storing the audio circuit and speaker components and connects to the second section in a manner that grips the hat material and provides access to the audio controls. In an alternative embodiment, the connection assembly may comprise a clip that secures the audio system to the hat without penetrating it. The assembly includes storage space for securing at least one speaker and audio system, which may be adapted for storing other items, such as money and keys.

It is an objective of the present invention to provide a hat mounted music system that allows for convenient and secure mounting of an iPod or MP3 player. It is a further objective to provide such a system that eliminates the need for loose wires that connect to earphones. It is a still further objective of the invention to provide a system that will securely position earphones over the ears of a user and allow the earphone to be quickly moved away from the ears as needed. It is yet a further objective to provide a system that can be recharged by means of solar radiation. It is still a further objective to provide a means for communications with a cellular telephone or GPS system. It is another objective of the invention to include a walkie-talkie capability in the device. Finally, it is an objective of the present invention to provide hat mounted flashlights in the system.

While some of the objectives of the present invention are disclosed in the prior art, none of the inventions found include all of the requirements identified.

SUMMARY OF THE INVENTION

The present invention addresses all of the deficiencies of prior art hat mounted music system inventions and satisfies all of the objectives described above.

(1) A hat mounted music system providing the desired features may be constructed from the following components. A semi-rigid hatband is provided. A flexible crown is mounted to the hatband. A hat bill is mounted to the hat band. A retaining pocket is provided. The pocket is mounted to the hatband and is sized and shaped to hold a portable music player. A portable music player is provided. The player is sized and shaped to fit within the retaining pocket. First and second headphone mounts are provided. The headphone mounts are located to align with the ears of a user of the system.

The mounts have first and second hinges. First portions of the hinges are attached to the hatband and second portions of the hinges are attached to the mounts. The hinges permit movement of the mounts from a first, open position to a second, listening position. First and second headphone modules are provided. The modules are adapted to fit the headphone mounts. Connection wires are provided. The wires connect the player to the headphone modules.

(2) In a variant of the invention each of the headphone mounts further includes a rotational coil spring. The spring urges the headphone mount upwardly, away from the ears of the user to the first, open position. A latching mechanism is provided. The latching mechanism retains the headphone mount adjacent the ears of the user in the second, listening position.

A release device is provided. The release device operates the latching mechanism and allows the headphone mount to move upwardly to the first, open position when activated. The user pushes the headphone mount downwardly against the urging of the coil spring and the latching mechanism retains the headphone mount in the second, listening position. The user activates the release device and the latching mechanism permits the headphone mount to move upwardly to the first, open position.

(3) In another variant, each of the headphone mounts further includes an elastic member. The elastic member has a first end and a second end. The member is attached at the first end to the second portion of one of the first and second hinges at a point spaced from a pivot pin of the hinge. The member is attached at the second end to the headphone mount at a point spaced from the pivot pin. Tension on the elastic member is reduced when the headphone mount is in either the first, open position or the second listening position. Tension on the elastic member is at a maximum at a point between the first and the second positions.

(4) In still another variant, the retaining pocket is mounted at either a central forward or a central rearward position on the hatband.

(5) In yet another variant, the pocket further includes a player restraint. The restraint prevents loss of the player during either travel or activity.

(6) In a further variant, the flexible crown provides a channel for the connection wires.

(7) In still a further variant, the hat bill further includes a solar array. The solar array is sized, shaped and configured to provide a direct current to a control circuit. The control circuit provides regulated voltage suitable for recharging batteries in the music player. Connection wires are provided. The connection wires connect the control circuit to a power connection for the music player.

(8) In yet a further variant, the system further includes a microphone. The microphone is mounted to an underside of the hat bill.

(9) In another variant of the invention, the system further includes controls and circuitry for wireless communication with a cellular telephone. The circuitry is connected to the headphone modules and the microphone.

(10) In still another variant the system further includes circuitry to provide an audio connection for a global positioning system to the headphone modules.

(11) In yet another variant, at least one flashlight module is provided. The module has a light source, a switch and a battery. The battery is rechargeable by the solar array.

(12) In a further variant, the system further includes a power source and circuitry for a two-way radio. The circuitry is connected to the microphone and at least one of the headphone modules.

(13) In still a further variant, the power source is a solar array mounted to the hat bill.

(14) In yet a further variant, the switch for the flashlight module includes a resilient cover. The cover prevents entrance of moisture into the switch.

(15) In another variant of the invention, an antenna, is located in the semi-rigid hatband.

(16) In still another variant, shielding is provided between the antenna and the user.

(17) In yet another variant, the headphone mounts include movable shutters. The shutters control admittance of ambient sounds to the headphone modules.

(18) In a further variant, the movable shutters include at least one curved slot. The slot is removably covered by a rotating disk. The disk is rotatably mounted to each of the headphone modules.

(19) In still a further variant, rotation of the disk is controlled by a spring-loaded ball mounted to the headphone module, the ball bearing upon a series of notches, the notches disposed upon an underside of the disk.

(20) In yet a further variant, the system includes either a manual or a voice-activated switch for the two-way radio.

(21) In another variant of the invention, an audio volume adjuster is provided. The adjuster modifies input to the headphone modules based upon ambient sound levels.

(22) In still another variant, an audio cutout circuit for the portable music player is provided. The cutout circuit is activated by input from an alternative audio source.

(23) In yet another variant, the hat mounted music system, includes a semi-rigid hatband, a flexible crown mounted to the hatband, a hat bill mounted to the hat band. A retaining pocket is provided. The pocket is mounted to the hatband and is sized and shaped to hold a device providing audio input. First and second headphone mounts are provided. The headphone mounts are located to align with ears of a user of the system. The mounts have first and second hinges. The first portions of the hinges are attached to the hatband and the second portions of the hinges are attached to the mounts. The hinges permit movement of the mounts from a first, open position to a second, listening position. First and second headphone modules are provided. The modules are adapted to fit the headphone mounts. Connection wires connect the device to the headphone modules.

In a final variant of the invention, the device that provides audio input is selected from the group that includes cellular telephones, two-way radios and Global Positioning Systems (GPS).

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-14 illustrate a hat mounted music system 10 providing the desired features that may be constructed from the following components. As illustrated in FIGS. 1-4, a semi-rigid hatband 14 is provided. A flexible crown 18 is mounted to the hatband 14. A hat bill 22 is mounted to the hat band 14. A retaining pocket 26 is provided. The pocket 26 is mounted to the hatband 14 and is sized and shaped to hold a portable music player 30. A portable music player 30 is provided. The player 30 is sized and shaped to fit within the retaining pocket 26. First 34 and second 38 headphone mounts are provided. The headphone mounts 34, 38 are located to align with the ears 42 of a user 46 of the system 10.

Figure 1:
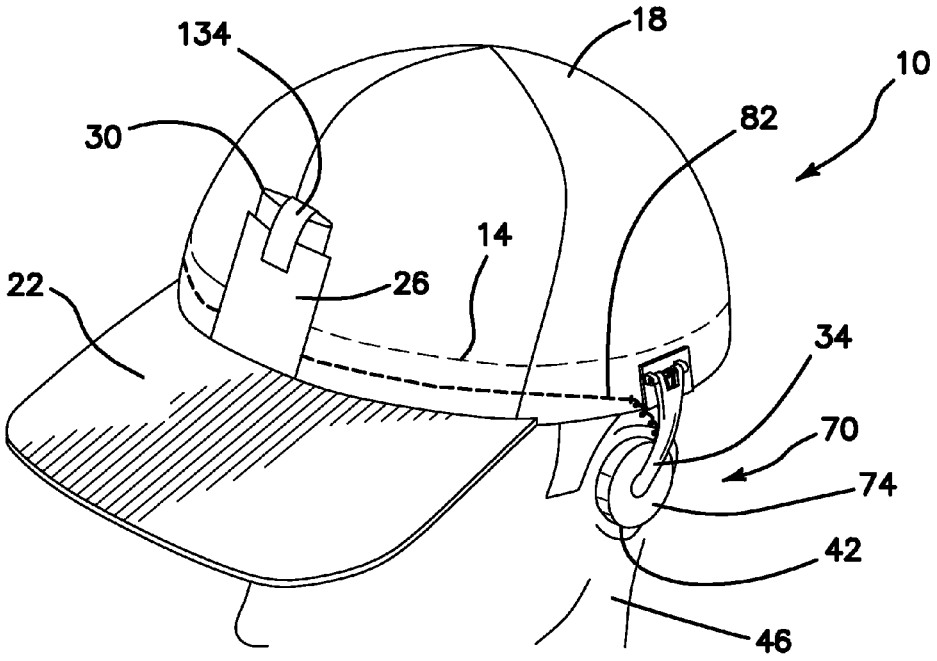
FIG. 1 is a perspective view of the preferred embodiment of the invention illustrating a retaining pocket for a music player and movable headphone mounts.

The mounts have first 50 and second 54 hinges. First portions 58 of the hinges 50, 54 are attached to the hatband 14 and second portions 62 of the hinges 50, 54 are attached to the mounts 34, 38. The hinges 50, 54 permit movement of the mounts 34, 38 from a first, open position 66 to a second, listening position 70. First 74 and second 78 headphone modules are provided. The modules 74, 78 are adapted to fit the headphone mounts 34, 38. Connection wires 82 are provided. The wires 82 connect the player 30 to the headphone modules 74, 78.

Figure 2:
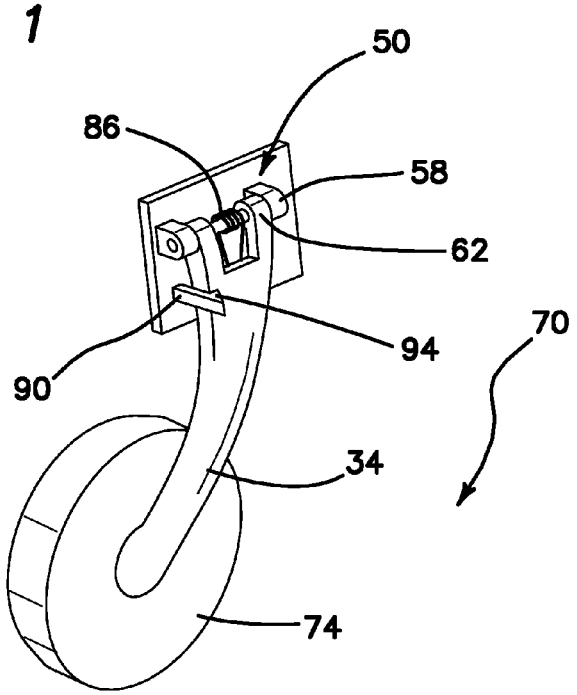
FIG. 2 is an enlarged perspective view of a first embodiment of a movable headphone mount and headphone module.
Figure 4:
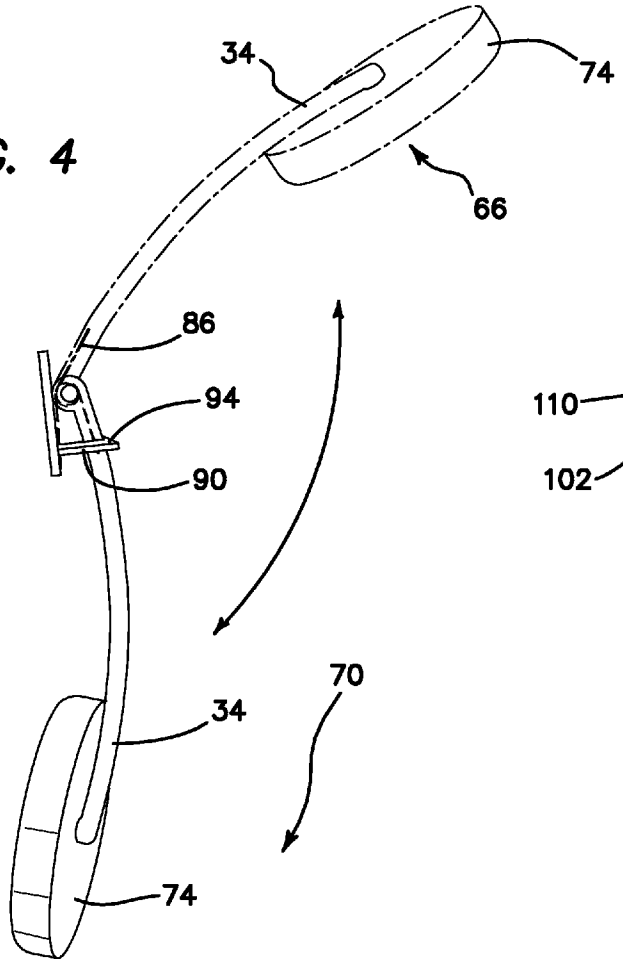
FIG. 4 is a perspective view of the first embodiment of the movable headphone mount illustrating both the open and listening positions.

(2) In a variant of the invention, as illustrated in FIGS. 2 and 4, each of the headphone mounts 34, 38 further includes a rotational coil spring 86. The spring 86 urges the headphone mount 34, 38 upwardly, away from the ears 42 of the user 46 to the first, open position 66. A latching mechanism 90 is provided. The latching mechanism 90 retains the headphone mount 34, 38 adjacent the ears 42 of the user 46 in the second, listening position 70.

A release device 94 is provided. The release device 94 operates the latching mechanism 90 and allows the headphone mount 34, 38 to move upwardly to the first, open position 66 when activated. The user 46 pushes the headphone mount 34, 38 downwardly against the urging of the rotational spring 86 and the latching mechanism 90 retains the headphone mount 34, 38 in the second, listening position 70. The user 46 activates the release device 94 and the latching mechanism 90 permits the headphone mount 34, 38 to move upwardly to the first, open position 66.

Figure 5:
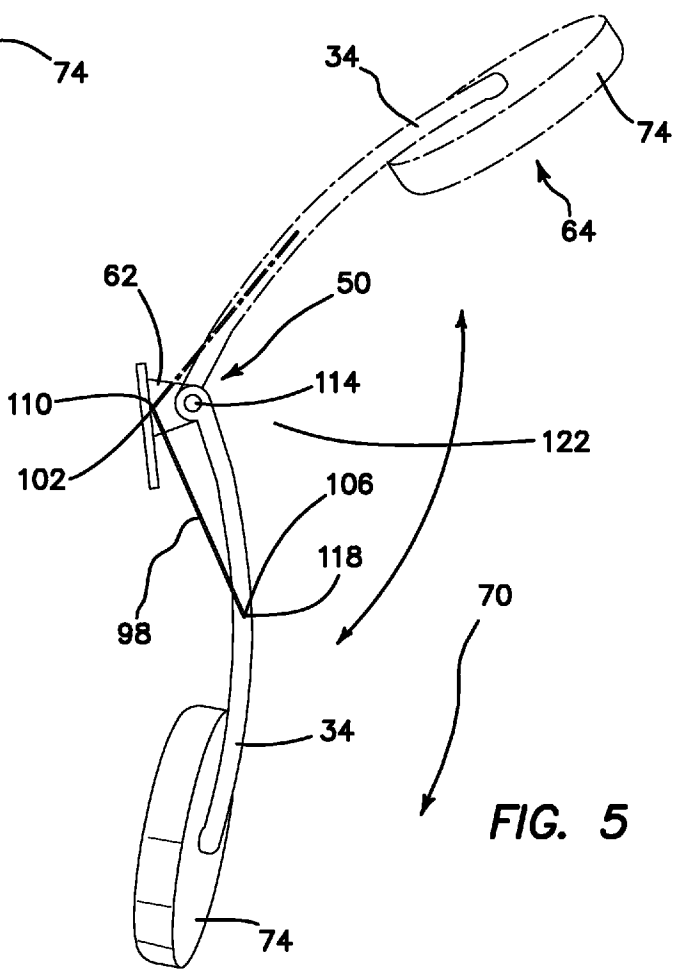
FIG. 5 is a perspective view of a second embodiment of the movable headphone mount illustrating both the open and listening positions.

(3) In another variant, as illustrated in FIG. 5, each of the headphone mounts 34, 38 further includes an elastic member 98. The elastic member 98 has a first end 102 and a second end 106. The member 98 is attached at the first end 102 to the second portion 62 of one of the first 50 and second 54 hinges at a point 110 spaced from a pivot pin 114 of the hinge 50, 54. The member 98 is attached at the second end 106 to the headphone mount 34, 38 at a point 118 spaced from the pivot pin 114. Tension on the elastic member 98 is reduced when the headphone mount 34, 38 is in either the first, open position 66 or the second listening position 70. Tension on the elastic member 98 is at a maximum at a point 122 between the first 66 and the second 70 positions.

Figure 3:
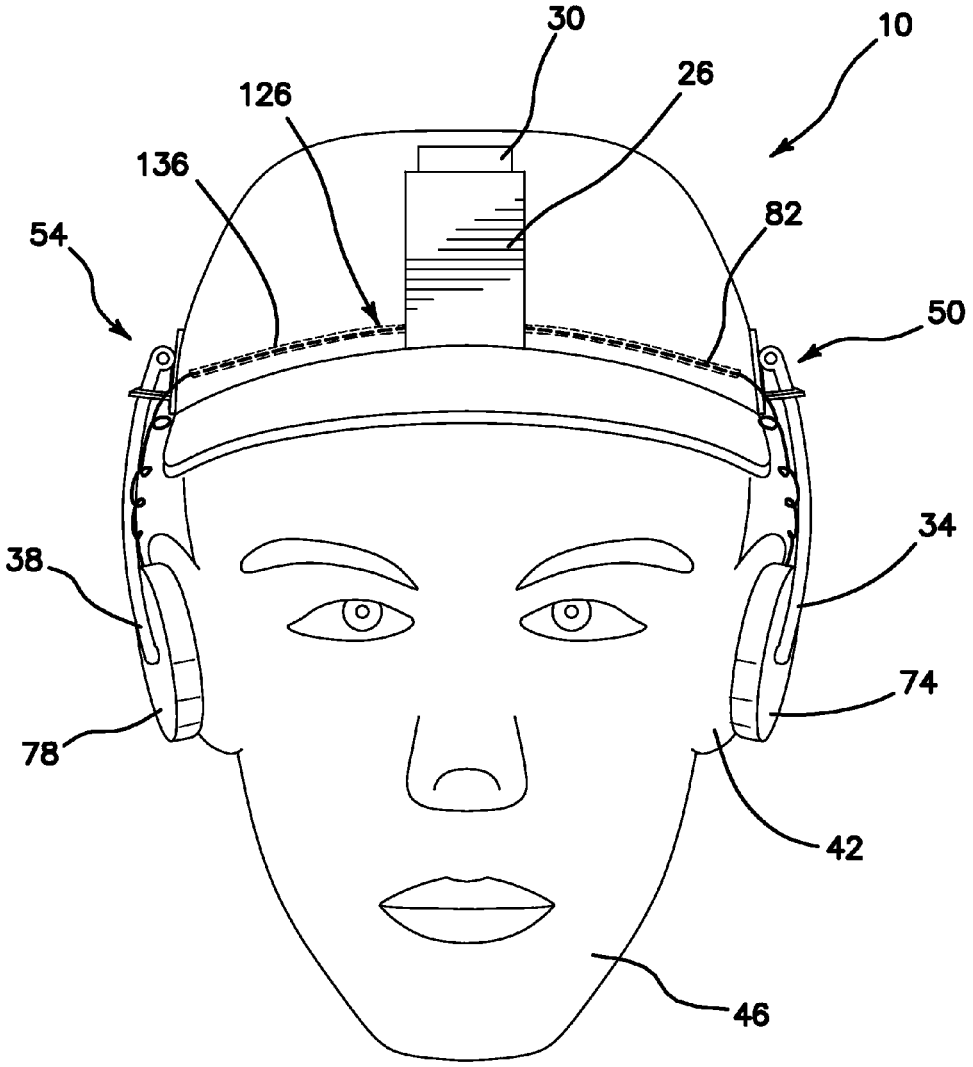
FIG. 3 is a perspective view of the FIG. 1 embodiment disposed upon a head of a user and illustrating both first and second headphone mounts.

(4) In still another variant, as illustrated in FIGS. 1 and 3, the retaining pocket 26 is mounted at either a central forward 126 or a central rearward (not shown) position on the hatband 14.

(5) In yet another variant, as illustrated in FIG. 1, the pocket 26 further includes a player restraint 134. The restraint 134 prevents loss of the player 30 during either travel or activity.

(6) In a further variant, as illustrated in FIG. 3, the flexible crown 18 provides a channel 136 for the connection wires 82.

Figure 6:
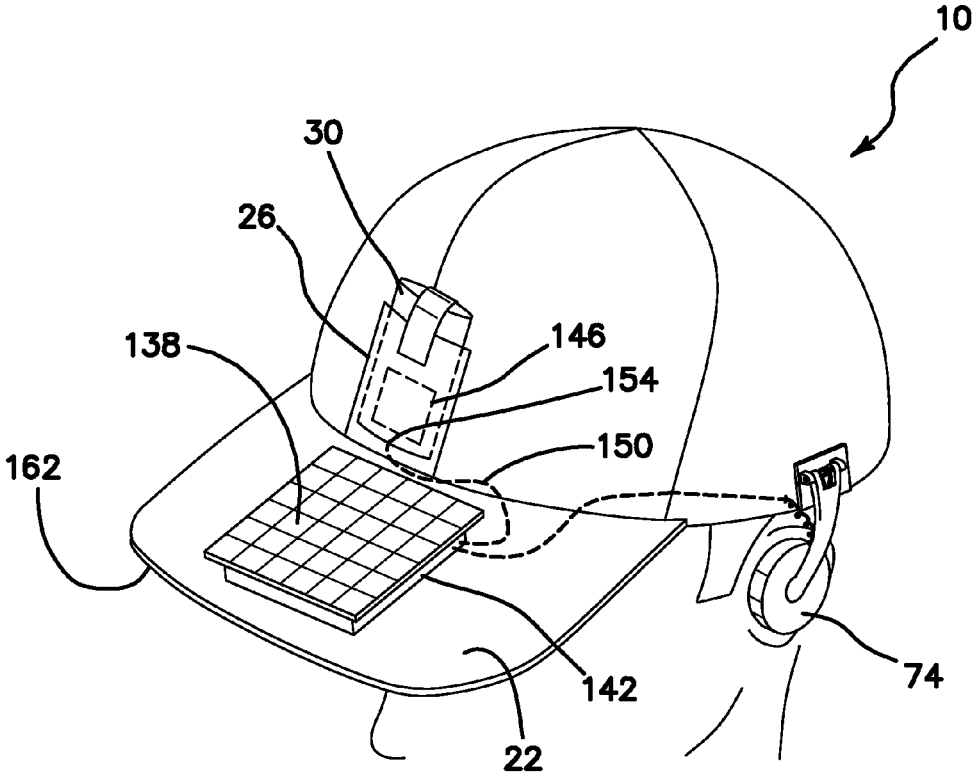
FIG. 6 is a perspective view of the FIG. 1 embodiment illustrating a solar array for powering the music player.

(7) In still a further variant, as illustrated in FIG. 6, the hat bill 22 further includes a solar array 138. The solar array 138 is sized, shaped and configured to provide a direct current to a control circuit 142. The control circuit 142 provides regulated voltage suitable for recharging batteries 146 in the music player 30. Connection wires 150 are provided. The connection wires 150 connect the control circuit 142 to a power connection 154 for the music player 30.

Figure 7:
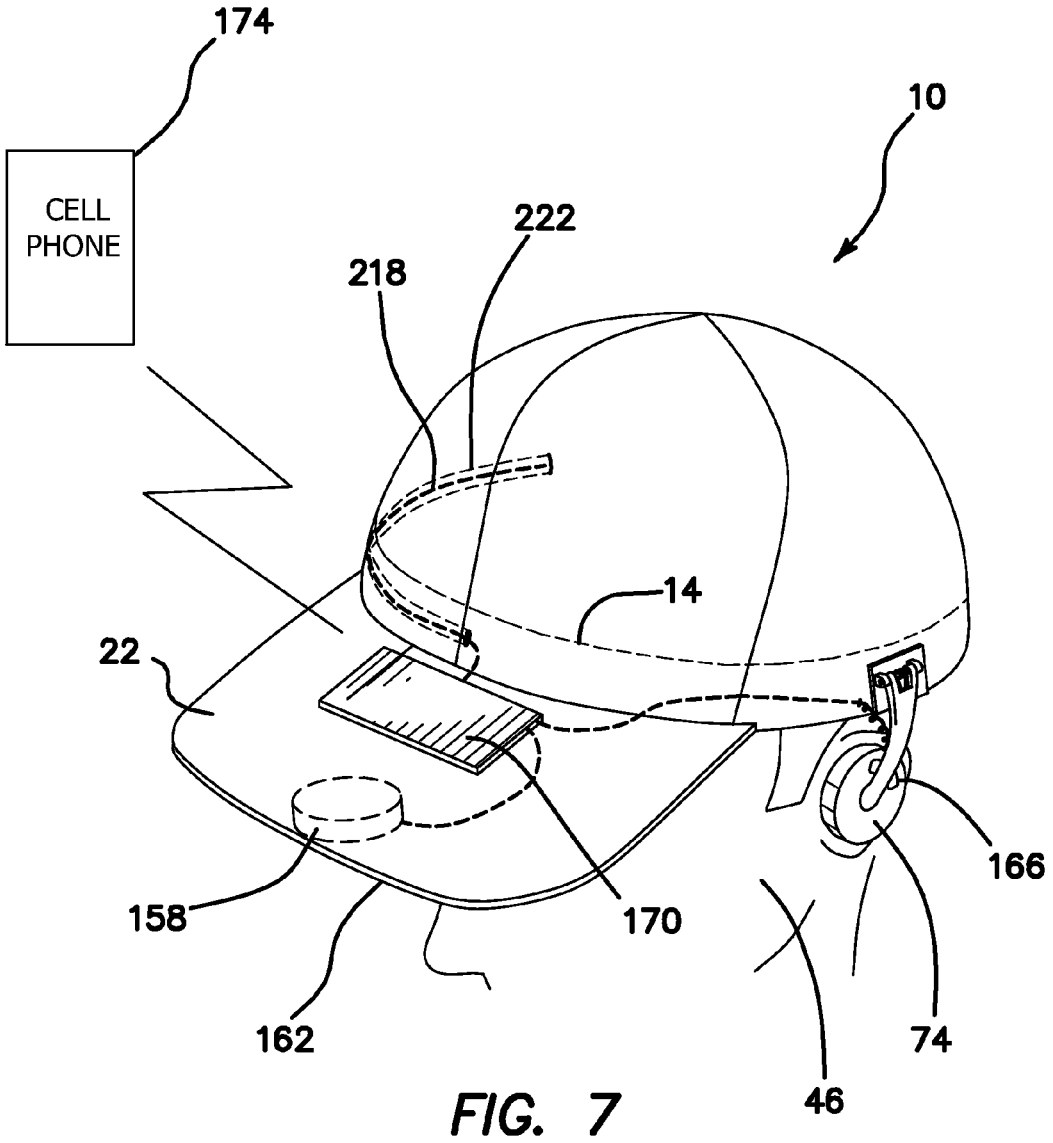
FIG. 7 is a perspective view of the FIG. 1 embodiment illustrating wireless circuitry and a microphone for use with a cellular telephone.

(8) In yet a further variant, as illustrated in FIG. 7, the system 10 further includes a microphone 158. The microphone 158 is mounted to an underside 162 of the hat bill 22.

(9) In another variant of the invention, the system 10 further includes controls 166 and circuitry 170 for wireless communication with a cellular telephone 174. The circuitry 170 is connected to the headphone modules 74, 78 and the microphone 158.

Figure 10:
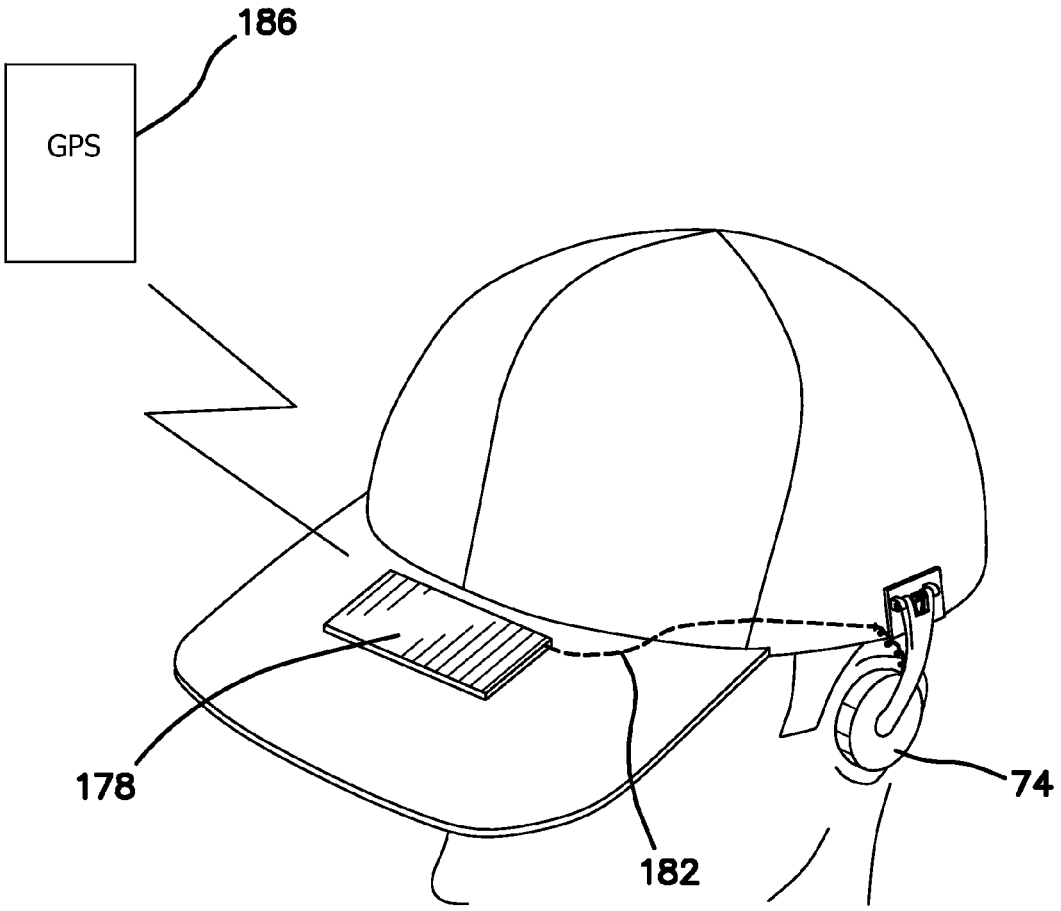
FIG. 10 is a perspective view of the FIG. 1 embodiment illustrating circuitry and an audio connection for a Global Positioning System.

(10) In still another variant, as illustrated in FIG. 10, the system 10 further includes circuitry 178 to provide an audio connection 182 for a global positioning system 186 to the headphone modules 74, 78.

Figure 9:
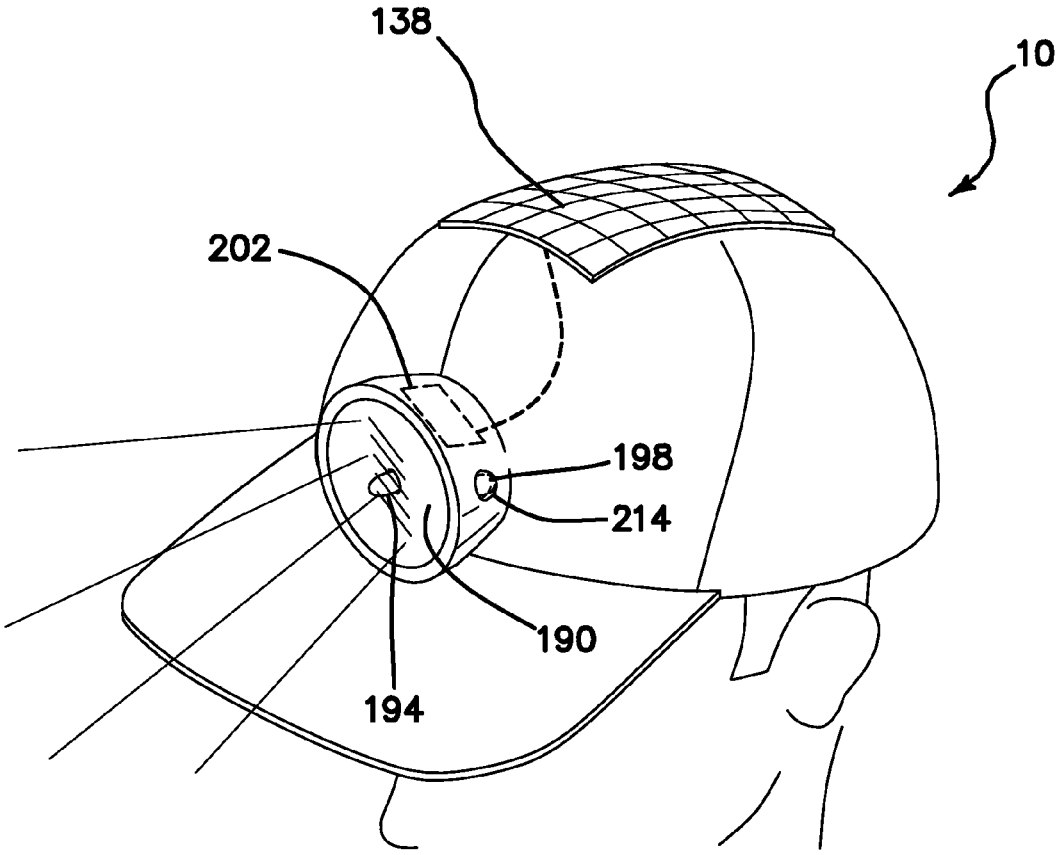
FIG. 9 is a perspective view of the FIG. 1 embodiment illustrating a flashlight with solar power source.

(11) In yet another variant, as illustrated in FIG. 9, at least one flashlight module 190 is provided. The module 190 has a light source 194, a switch 198 and a battery 202. The battery 202 is rechargeable by the solar array 138.

Figure 8:
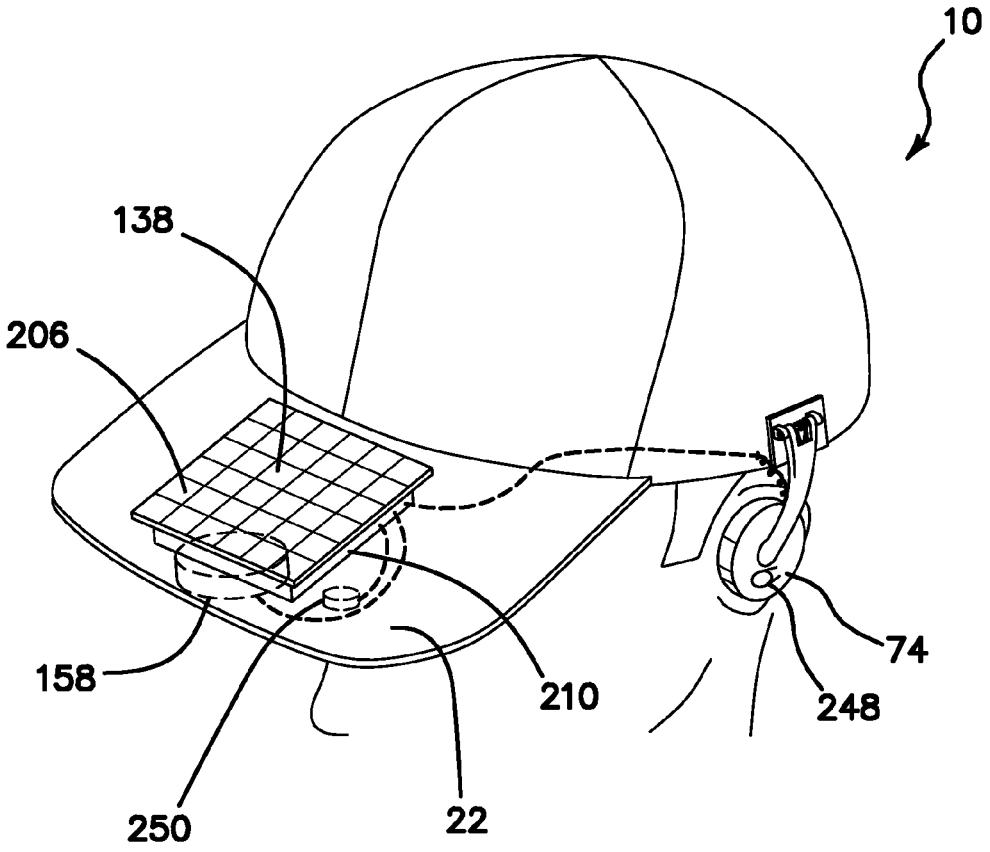
FIG. 8 is a perspective view of the FIG. 1 embodiment illustrating a solar array, microphone, circuitry for a two-way radio and a voice activation switch.

(12) In a further variant, as illustrated in FIG. 8, the system 10 further includes a power source 206 and circuitry for a two-way radio 210. The circuitry 210 is connected to the microphone 158 and at least one of the headphone modules 74, 78.

(13) In still a further variant, the power source 206 is a solar array 138 mounted to the hat bill 22.

(14) In yet a further variant, as illustrated in FIG. 9, the switch 198 for the flashlight module 190 includes a resilient cover 214. The cover 214 prevents entrance of moisture into the switch 198.

(15) In another variant of the invention, as illustrated in FIG. 7, an antenna 218, is located in the semi-rigid hatband 14.

(16) In still another variant, shielding 222 is provided between the antenna 218 and the user 46.

Figure 11:
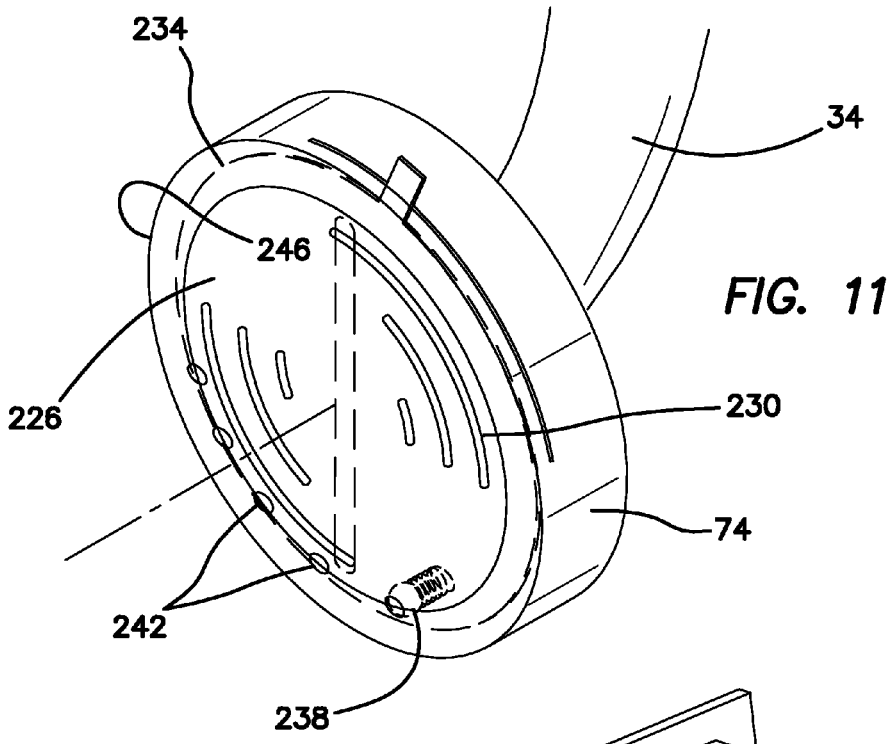
FIG. 11 is a perspective view of a headphone module with rotating shutter disk and rotation control ball.

(17) In yet another variant, as illustrated in FIG. 11, the headphone mounts 34, 38 include movable shutters 226. The shutters 226 control admittance of ambient sounds to the headphone modules 74, 78.

(18) In a further variant, the movable shutters 226 include at least one curved slot 230. The slot 230 is removably covered by a rotating disk 234. The disk 234 is rotatably mounted to each of the headphone modules 74, 78.

(19) In still a further variant, rotation of the disk 234 is controlled by a spring-loaded ball 238 mounted to the headphone modules 74, 78, the ball 238 bearing upon a series of notches 242, the notches 242 disposed upon an underside 246 of the disk 234.

(20) In yet a further variant, as illustrated in FIG. 8, the system 10 includes either a manual 248 or a voice-activated 250 switch for the two-way radio 210.

Figure 12:
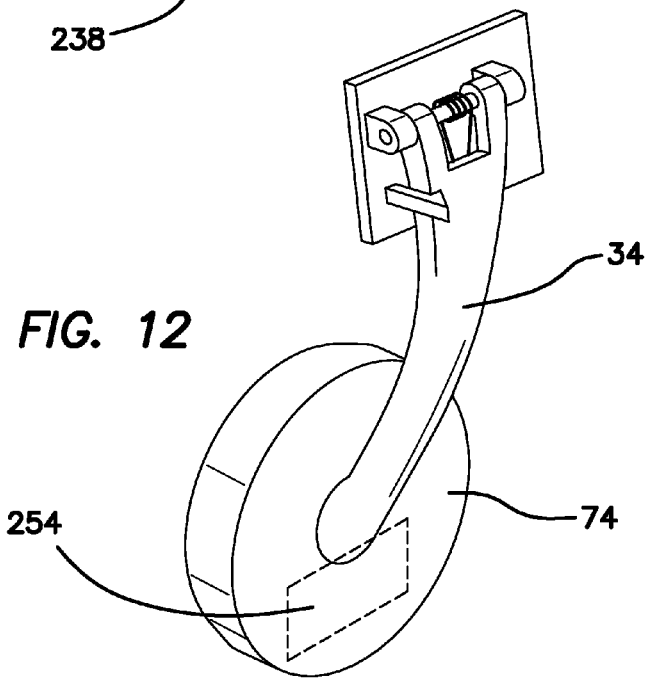
FIG. 12 is a perspective view of a headphone module with ambient sound activated volume control.

(21) In another variant of the invention, as illustrated in FIG. 12, an audio volume adjuster 254 is provided. The adjuster 254 modifies input to the headphone modules 74, 78 based upon ambient sound levels.

Figure 13:
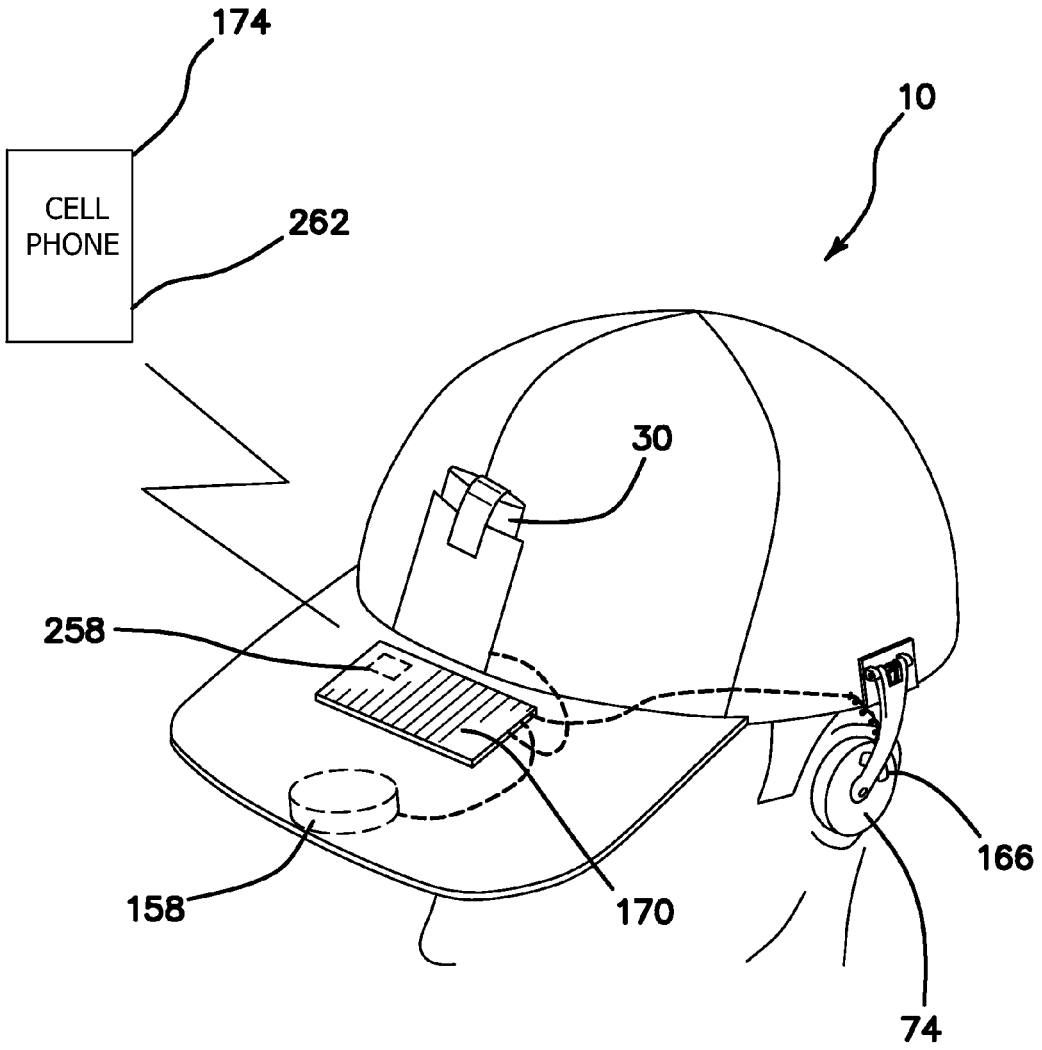
FIG. 13 is a perspective view of the FIG. 1 embodiment illustrating wireless circuitry for use with a cellular telephone having an automatic cutoff circuit for the music player.

(22) In still another variant, as illustrated in FIG. 13, an audio cutout circuit 258 for the portable music player 30 is provided. The cutout circuit 258 is activated by input from an alternative audio source 262.

Figure 14:
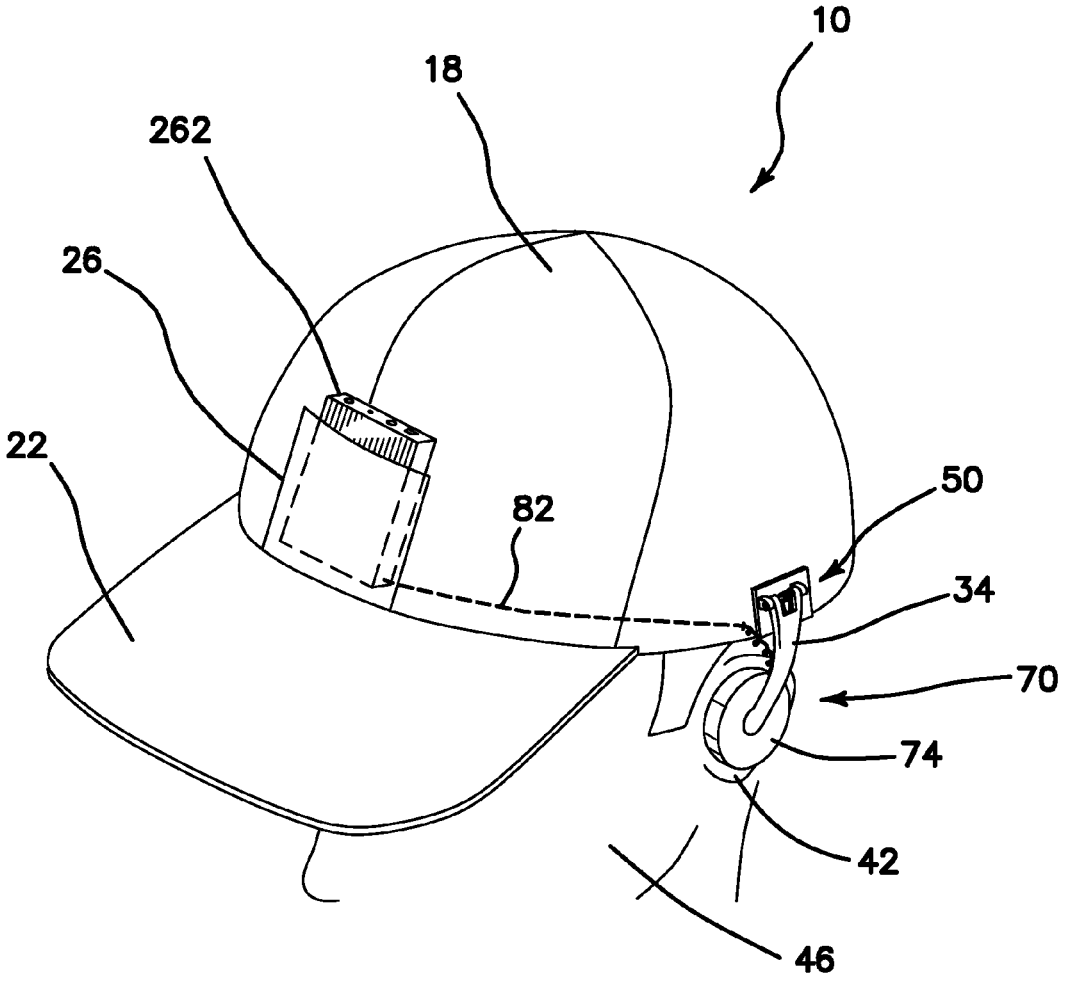
FIG. 14 is a perspective view of an alternative embodiment of the invention for use with an alternative audio source.

(23) In yet another variant, as illustrated in FIG. 14, the hat mounted music system 10, includes a semi-rigid hatband 14, a flexible crown 18 mounted to the hatband 14, a hat bill 22 mounted to the hat band 14. A retaining pocket 26 is provided. The pocket 26 is mounted to the hatband 14 and is sized and shaped to hold a device providing audio input 262. First 34 and second 38 headphone mounts are provided. The headphone mounts 34, 38 are located to align with ears 42 of a user 46 of the system 10. The mounts 34, 38 have first 50 and second 54 hinges. The first portions 58 of the hinges 50, 54 are attached to the hatband 14 and the second portions 62 of the hinges 50, 54 are attached to the mounts 34, 38. The hinges 50, 54 permit movement of the mounts 34, 38 from a first, open position 66 to a second, listening position 70. First 74 and second 78 headphone modules are provided. The modules 74, 78 are adapted to fit the headphone mounts 34, 38. Connection wires 82 connect the device 262 to the headphone modules 74, 78.

(24) In a final variant of the invention, the device that provides audio input 262 is selected from the group that includes cellular telephones 174, two-way radios 210 and Global Positioning Systems (GPS) 186.

The hat mounted music system 10 has been described with reference to particular embodiments. Other modifications and enhancements can be made without departing from the spirit and scope of the claims that follow.

The invention claimed is:

1. A hat mounted music system, comprising:

a semi-rigid hatband;

a flexible crown mounted to said hatband;

a hat bill mounted to said hat band;

a retaining pocket, said pocket being mounted to said hatband and being sized and shaped to hold a portable music player;

a portable music player, said player being sized and shaped to fit within said retaining pocket;

a microphone, said microphone being mounted to an underside of said hat bill;

first and second headphone mounts, said headphone mounts being disposed to align with ears of a user of said system;

said mounts having first and second hinges, first portions of said hinges being attached to said hatband and second portions of said hinges being attached to said mounts, said hinges permitting movement of said mounts from a first, open position to a second, listening position;

each of said headphone mounts further comprises:

a rotational coil spring, said spring urging said headphone mount upwardly, away from said ears of said user to said first, open position;

a latching mechanism, said latching mechanism retaining said headphone mount adjacent said ears of said user in said second, listening position;

a release device, said release device operating said latching mechanism and allowing said headphone mount to move upwardly to said first, open position when activated;

wherein said user pushes said headphone mount downwardly against urging of said coil spring and said latching mechanism retains said headphone mount in said second, listening position; and wherein said user activates said release device and said latching mechanism permits said headphone mount to move upwardly to said first, open position;

first and second headphone modules, said modules adapted to fit said headphone mounts; and connection wires, said wires connecting said player to said headphone modules.

2. The hat mounted music system, as described in claim 1, wherein each of said headphone mounts further comprises:

an elastic member, said elastic member having a first end and a second end and being attached at said first end to said second portion of one of said first and second hinges at a point spaced from a pivot pin of said hinge and being attached at said second end to said headphone mount at a point spaced from said pivot pin; and wherein tension on said elastic member is reduced when said headphone mount is in either of said first, open position and said second listening position and tension on said elastic member is at a maximum at a point between said first and said second positions.

3. The hat mounted music system, as described in claim 1, wherein said hat bill further comprises:

a solar array, said solar array being sized, shaped and configured to provide a direct current to a control circuit;

said control circuit providing regulated voltage suitable for recharging batteries in said music player; and connection wires, said connection wires connecting said control circuit to a power connection for said music player.

4. The hat mounted music system, as described in claim 3, further comprising at least one flashlight module, said module having a light source, a switch and a battery, said battery being rechargeable by said solar array.

5. The hat mounted music system, as described in claim 4, wherein said switch includes a resilient cover, said cover preventing entrance of moisture into said switch.

6. The hat mounted music system, as described in claim 1, further comprising controls and circuitry for wireless communication with a cellular telephone, said circuitry connected to said headphone modules and said microphone.

7. The hat mounted music system, as described in claim 6, further comprising an antenna, said antenna being disposed in said semi-rigid hatband.

8. The hat mounted music system, as described in claim 7, further comprising shielding between said antenna and said user.

9. The hat mounted music system, as described in claim 1, further comprising circuitry to provide an audio connection for a global positioning system to said headphone modules.

10. The hat mounted music system, as described in claim 1, further comprising, a power source and circuitry for a two-way radio, said circuitry connected to said microphone and at least one of said headphone modules.

11. The hat mounted music system, as described in claim 10, wherein said power source is a solar array mounted to said hat bill.

12. The hat mounted music system, as described in claim 10, further comprising either of a manual and a voice-activated switch for said two-way radio.

13. The hat mounted music system, as described in claim 1, wherein said headphone mounts further comprise movable shutters, said shutters controlling admittance of ambient sounds to said headphone modules.

14. The hat mounted music system, as described in claim 13, wherein said movable shutters comprise at least one arcurate slot, said slot being removably covered by a rotating disk, said disk being rotatably mounted to each of said headphone module.

15. The hat mounted music system, as described in claim 14, wherein rotation of said disk is controlled by a spring-loaded ball mounted to said headphone module, said ball bearing upon a series of notches, said notches disposed upon an underside of said disk.

16. The hat mounted music system, as described in claim 1, further comprising an audio volume adjuster, said adjuster modifying input to said headphone modules based upon ambient sound levels.

17. 1The hat mounted music system, as described in claim 1, further comprising an audio cutout circuit for said portable music player, said cutout circuit being activated by input from an alternative audio source.

18. The hat mounted music system, comprising:

a semi-rigid hatband;

a flexible crown mounted to said hatband;

a hat bill mounted to said hat band;

a retaining pocket, said pocket being mounted to said hatband and being sized and shaped to hold a device providing audio input;

first and second headphone mounts, said headphone mounts being disposed to align with ears of a user of said system;

said mounts having first and second hinges, first portions of said hinges being attached to said hatband and second portions of said hinges being attached to said mounts, said hinges permitting movement of said mounts from a first, open position to a second, listening position;

a latching mechanism, said latching mechanism retaining said headphone mount adjacent said ears of said user in said second, listening position;

first and second headphone modules, said modules adapted to fit said headphone mounts;

said headphone mounts adapted to removably locate said headphone modules directly upon said ears when disposed in said second, listening position; and connection wires, said wires connecting said device to said headphone modules.

19. The hat mounted music system, as described in claim 18, wherein said device providing audio input is selected from the group comprising:

cellular telephones, two-way radios and Global Positioning Systems (GPS).

* * * * *